United States Patent [19]

Eull

[11] 4,019,837

[45] Apr. 26, 1977

[54] PRESSURE UNLOADING APPARATUS FOR A DIAPHRAGM PUMP

[75] Inventor: Marvin J. Eull, St. Michael, Minn.

[73] Assignee: Graco Inc., Minneapolis, Minn.

[22] Filed: May 30, 1975

[21] Appl. No.: 582,262

[52] U.S. Cl. ..... 417/386; 417/388

[51] Int. Cl.[2] ..... F04B 9/08; F04B 35/02

[58] Field of Search ..... 417/385, 386, 388

[56] References Cited

UNITED STATES PATENTS

| | | | |
|---|---|---|---|
| 2,753,805 | 7/1956 | Boivinet | 417/388 |
| 2,919,650 | 1/1960 | Wiggermann | 417/386 |
| 3,151,562 | 10/1964 | Swartz | 417/388 |
| 3,276,673 | 10/1966 | Jones et al. | 417/385 |
| 3,416,453 | 12/1968 | Feuillebois et al. | 417/386 |

*Primary Examiner*—Carlton R. Croyle
*Assistant Examiner*—Thomas I. Ross
*Attorney, Agent, or Firm*—Paul L. Sjoquist

[57] ABSTRACT

Apparatus is disclosed for unloading excess pressures developed in a hydraulic diaphragm pump, wherein the pressure of the pumped fluid is sensed by a control diaphragm connected to an unloading valve which is placed in a passage connecting the hydraulic displacement chamber with a hydraulic oil reservoir.

2 Claims, 2 Drawing Figures

PRESSURE UNLOADING APPARATUS FOR A DIAPHRAGM PUMP

BACKGROUND OF THE INVENTION

This invention relates to an apparatus for controlling internal pressure overloads in a hydraulic pump. More particularly, the apparatus is preferably adaptable for use in a piston-actuated diaphragm pump, whereby pressure unloading must be utilized to prevent damage to the diaphragm in cases where the pumped fluid pressure fluctuates, either because of a fluid flow shutoff downstream or because of a drop in fluid supplied to the pump. For example, if a hydraulic diaphragm pump is utilized to pump water, paint, or some other fluid through a hose and nozzle configuration for spraying or cleaning, and if the nozzle is triggered off, the hydraulic pressure immediately builds up in the delivery hose and feeds back to the diaphragm pump, wherein it is detected as an accumulation of fluid in the pumping chamber acting in opposition to the diaphragm. Since a diaphragm pump typically has a mechanically reciprocated piston, the compression stroke of the piston will pressurize the hydraulic oil on the pumping side of the diaphragm in opposition to the blocked pumped fluid chamber. Since the fluids are incompressible, the mechanically actuated piston will suddenly encounter a stall force in the absence of any pressure relieving mechanism. Such a stall pressure could damage or destroy the pump by rupturing the diaphragm or breaking the mechanical moving parts.

This problem is typical resolved by providing a pressure unloading means on one side of the diaphragm or the other. This pressure unloadding means usually operates to cause a bleeder valve to open whenever a predetermined pressure level is sensed, and the compressed fluid is allowed to escape into an unpressurized area. If the pressure unloading means is placed on the pumped fluid side of the diaphragm, it merely allows pumped fluid to escape from the pump chamber into an accumulator to recirculating passage. If the pressure unloading mechanism is located on the hydraulic oil side of the diaphragm, it generally permits excess hydraulic oil pressure to be relieved back into the hydraulic oil reservoir associated with pumps of this type. Of course, additional valving means must be provided to enable replenishing of the hydraulic oil chamber whenever such a bleedoff has occurred, in order for normal pumping to again resume after the pressure load has been relieved.

In the prior art, hydraulic diaphragm pumps have utilized a great number of schemes for regulating over pressures of fluid acting against a flexible and sensitive diaphragm. For example, U.S. Pat. No. 2,753,805 discloses a hydraulic diaphragm pump having an auxiliary diaphragm connected to a slide valve which is spring-biased to a preset pressure overload valve. As the pressure in the pumped fluid chamber, relative to the hydraullic chamber pressure, drops below a preset limit the slide valve opens to allow excess hydraulic oil from the displacement chamber to be passed back to the hydraulic oil reservior. This patent utilizes a number of check and slide valves, and may be considered to be a forerunner of the present invention. It is of particular interest because it provides a means for an auxiliary sensing diaphragm for monitoring pressure differentials between the pumped fluid chamber and the hydrualic oil displacement chamber, and it provides valving to allow hydraulic oil to be bypassed back to the reservoir whenever preset pressure differential limits are exceeded.

SUMMARY OF THE INVENTION

The present invention utilizes an auxiliary diaphragm in communication with the pumped liquid fluid path downstream of the pumped liquid chamber in the pump. This auxiliary diaphragm responds to pressure differentials between the downstream pumped liquid and the hydraulic displacement chamber whereby a build up of downstream pressure in excess of a predetermined amount causes the auxiliary diaphragm to deflect and open a bypass valve which relieves hydraulic oil pressure from the displacement chamber. A second feature of the invention includes a second operative surface on the same bypass valve in direct communication with the hydraulic oil displacement chamber to open the valve to relieve predetermined excess hydraulic oil displacement chamber pressures regardless of the pressure condition downstream of the pump. Thus, the invention relieves excess hydraulic oil pressure not only when downstream fluid flow is blocked but also when it may be unblocked but excessive internal hydraulic pressures have developed.

The auxiliary diaphragm of the present invention responds to a downstream blocked line condition by holding open the bypass valve for so long as the blocked line condition exists, thus porting hydraulic oil directly between the hydraulic oil displacement chamber and reservoir. This relieves the reciprocating piston from working against hydraulic oil back pressures when there is no flow in the downstream line, providing an attendant savings in pump energy consumption.

BRIEF DESCRIPTION OF THE DRAWING

A preferred embodiment of the invention is described herein, and in the appended drawings in which.

DETAILED DESCRIPTION OF THE INVENTION

Figure 1:
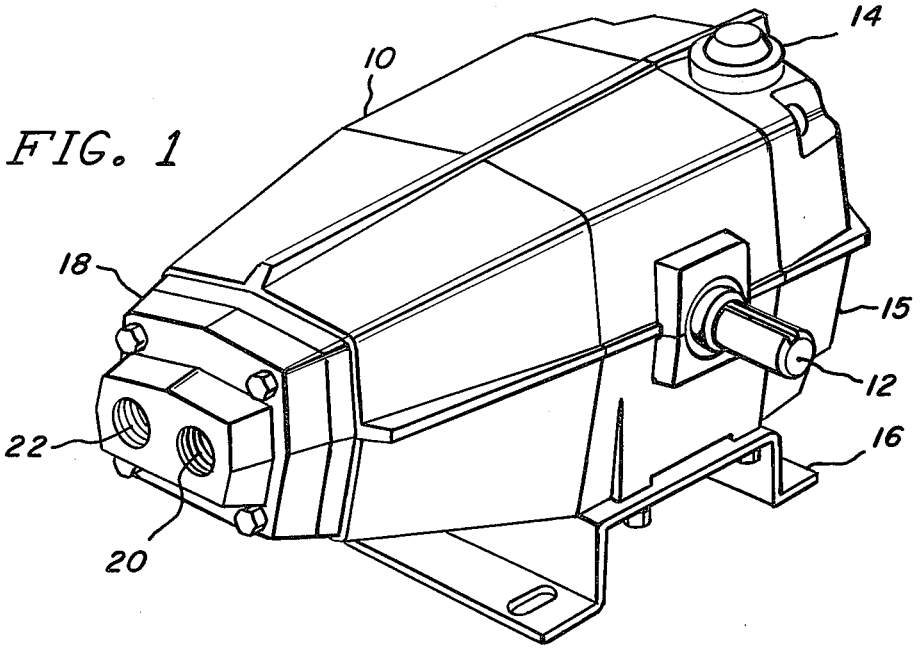
FIG. 1 shows the invention in perspective view.

Referring first to FIG. 1, the invention is shown in perspective view. A top cover 10 is attached to a bottom housing 15 by suitable fastening means, including a gasket to prevent oil leakage. The bottom housing 15 is in turn bolted to a mounting bracket 16 which may be attached to any convenient mounting surface. A rotary power source, such as an electric motor, is coupled to drive shaft 12 to provide the mechanical rotational motion utilized by the pump. Drive shaft 12 is mounted in housing 15 on suitable bearing surfaces.

An oil reservoir is provided internal to cover 10 and housing 15 for holding a quantity of hydraulic oil for purposes to be hereinafter described. An oil reservoir cap 14 provides a removable means for refilling this oil reservoir.

A check valve housing 18 is bolted to the end of the pump assembly. Housing 18 has a threaded inlet port 20 for receiving a fluid to be pumped, and a threaded output port 22 for pumping the fluid from the apparatus. The inlet and outlet ports are respectively connected to a supply of fluid for pumping and to a delivery system, typically including a length of hose with a suitable nozzle and trigger assembly for controlling fluid delivery. Under typical operating conditions, the fluid inlet to port 20 is at or near atmospheric pressure and the fluid pumped through outlet port 22 is pressurized to a range of 100–2,000 p.s.i.

Figure 2:
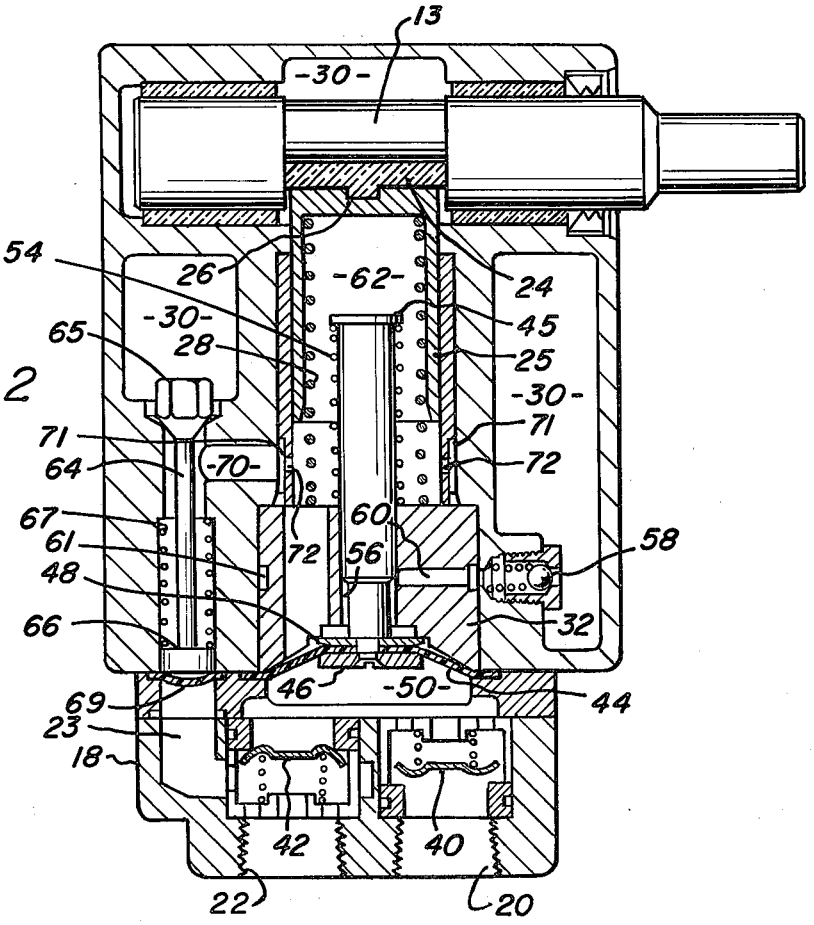
FIG. 2 shows the invention in cross section and top view.

FIG. 2 illustrates a top cross-sectional view of the invention. The mechanical drive components associated with present invention themselves comprises an invention which is disclosed in Copending U.S. patent application, Ser. No. 593,449 filed July 7, 1975 owned by the same assignee as the present invention. Drive shaft 12 has a crank shaft portion 13 which is eccentrically positioned relative to the axis of driveshaft 12. Crank 13 is coupled to a piston 25 by means of a single journal bearing 24 having a central raised shoulder 26 which mates with a corresponding slot in piston 25. Piston 25 is resiliently held against journal bearing 24 by means of compression spring 28. The entire assembly, including crank 13, bearing 24 and piston 25 is immersed into an oil reservoir 30 which is filled with hydrallic oil as hereinbefore described.

Pumped fluid inlet port 20 communicates with a chamber 50 through a check valve 40. Check valve 40 is spring loaded to admit fluid into chamber 50 under a suction pressure and to close and block the return flow of such fluid when the pressure becomes equalized. Check valve 40 is of a construction which is well known in the art. Check valve 42 controls communication between outlet port 22 and chamber 50. Check valve 42 is spring biased to open upon sensing a positive pressure in chamber 50 relative to outlet port 22, and it closes wherever the pressure becomes equalized. Check valve 42 is of a commonly used construction, and serves to assist in the pumping action of the apparatus.

The suction pressure which opens check valve 40 and the compression pressure which opens check valve 42 are each provided by proper movement of diaphragm 44. Diaphraggm 44 is a flexible membrane, preferably of plastic, which sealably isolates chamber 50 from the hydraulic oil-filled chambers and ports connected to oil reservoir 30. The maximum excursion of diaphragm 44 is limited by a diaphragm stop 46 on the pumped fluid side of the diaphragm, and is limited by a diaphragm stop 48 on the hydraulic oil side of the diaphragm. Stop 46 contacts a shoulder 17 on the inner check valve housing 18 to limit its compression stroke motion. Stop 48 contacts pumping chamber housing 32 to limit its suction stroke maximum deflection. In the absence of a pressure differential across diaphragm 44, the diaphragm is spring biased to its maximum suction positin by means of spring 54 which acts between the pumping chamber housing 32 and a diaphragm-connected stem 45.

Stem 45 has a slide valve portion 56 which uncovers passage 60 when stem 45 is in its rear most position. Passage 60 opens into reservoir 30 through a check valve 58 which is spring-biased to open when a positive pressure exists in reservoir 30 relative to the hydraulic pressure in displacement chamber 62. Displacement chamber 62 comprises that interior volume defined by the interior surface of piston 25, a plurality of passages through housing 32, and the volumetric space immediately adjacent disphargm 44 on the hydraulic oil side, including volumetric space surrounding the narrowed portion of stem 45.

Check valve 58 acts as replenishing valve to replace hydralic oil into displacement chamber 62 whenever a deficiency in the volume quantity of this oil is determined. A deficiency in hydraulic oil in displacement chamber 62 will cause diaphram stop 48 to bottom out against housing 32, thereby opening slide valve 56 to passage 60. If a pressure differential exists, hydraulic oil from reservoir 30 passes through check valve 58 and passage 60 into the displacement chamber 62 to alleviate the pressure differential. This has the result of refilling displacement chamber 62 with a sufficient quantity of oil to maintain a pressure equalibrium between the reservoir 30 and the displacement chamber whenever the pumping diaphagm 44 is positioned at its maximum suction stroke. If an excess of hydraulic oil is contained in displacement chamber 62 stop 48 will not reach it seat against housing 32 and slide valve 56 will cover passage 60, thus preventing a fluid flow path between oil reservoir 30 and displacement chamber 62. It should be noted that a plurality of passages 60 may be utilized with the invention for increasing the rate at which hydraulic oil will flow into displacement chamber 62. Additional passages 60 can be fluid coupled to check valve 58 by means of an annular groove 61 which encircles housing 32 and communicates with check valve 58.

A port 70 communicates with displacement chamber 62 via a plurality of openings 72 which are arranged in fluid communication with chamber 62 and port 70 via an annular groove 71, which is formed around the cylinder circumference. Openings 72 are continually in fluid communication with displacement chamber 62 regardless of the position of piston 25, for the openings are located forward of the maximum stroke of piston 25. Port 70 opens into a fluid chamber which is separated from oil reservoir 30 by means of valve 65. Valve 65 is connected via a stem 64 to a plunger 66. Plunger 66 is biased by a spring 67 against control diaphragm 69. The other side of control diaphragm 69 is exposed to the interior of a control chamber 23, which chamber opens into the region of outlet port 22. Control chamber 23 is filled with pumped fluid at the same pressure as is present in outlet port 22 and elsewhere in the outlet fluid line. Therefore, the relative deflection of control diaphragm 69 depends upon the pumped fluid pressure acting in opposition to the biasing force of spring 67. If pumped fluid pressure exceeds the force of spring 67, control diaphragm 69 deflects inwardly to open valve 65 and provide a hydraulic oil communication path from displacement chamber 62 into the oil reservoir 30. When this happens, hydraulic pressure is relieved from displacement chamber 62 and the pump will no longer develop the pumping action required to open check valve 42. Whenever fluid pressure in outlet port 22 drops below a predetermined value, spring 67 acts against plunger 66 to close valve 65. This allows the hydraulic oil pressure in displacement chamber 62 to again build up to a value for pumping. Should a dificiency in hydraulic oil develop in displacement chamber 62 during the time when valve 65 is opened, replenishing check valve 58 will later, after valve 65 is closed, open to admit hydraulic oil from reservoir 30 back into displacement chamber 62.

The hydraulic oil pressure in port 70, and in the chamber associated with stem 64, spring 67, and plunger 66, is always equal to the hydraulic oil pressure within displacement chamber 62. Because plunger 66 is loosely seated, hydraulic oil is found on all sides of the plunger, thus providing a net zero force for moving the plunger in any direction. There are essentially three forces which act upon plunger 66 and valve stem 64 to cause movement. First, the pumped fluid presure transferred across control diaphragm 69 causes a force tending to move plunger 66 inwardly and to open valve 65. Second, the force of spring 67 urges against the underside of plunger 66 and tends to move the plunger outwardly to close valve 65. Finally, the force of pressurized hydraulic oil against the conical valve surface of valve 65 tends to move the valve inwardly, thus opening valve 65. This last-named force also acts in opposition to spring 67, and is utilized in the present invention to provide a means for unloading excessive hydraulic oil pressure. This additional force on valve 65 acts in conjuction with pumped fluid pressures in chamber 23 to oppose the force of spring 67 and thereby to open valve 65.

In operation, the control disphragm monitors pump output pressure and controls, through the apparatus described herein, the hydraulic fluid pressure in response thereto. If output pressure rises above a predetermined level the control diaphragm opens valve 65 to unload the internal hydraulic fluid pressure and effectively to stop further pumping action by pumping diaphragm 44. A subsequent drop in output pressure causes the pump to resume its pumping action. Secondly, if internal hydralic fluid pressure builds up due to an excessive accumulation of hydraulic fluid in the displacement chamber, valve 65 is forced open to relieve such excess accumulation and to return the hydraulic fluid pressure levels to an acceptable operating range. Finally, if internal hydraulic fluid pressure drops due to a deficiency of hydraulic fluid in the displacement chamber, valve 58 opens passage 60 during the return stroke of the piston to admit additiional hydraulic fluid into the displacement chamber. The invention therefore provides compensation for all possible variations in internal hyraulic fluid pressure level, as well as relief for excessive output pressure levels.

What is claimed is:

1. A diaphragm pump apparatus of the type having a mechanically reciprocated piston driving a pumping diaphragm through an intermediary hydraulic fluid displacement chamber to cause the pumping diaphragm to deflect to pump liquid through an inlet and outlet check valve to an output, comprising:

a. a hydraulic fluid reservoir in said apparatus for storing a supply of hydraulic fluid;

b. a fluid chamber having a passage to said hydraulic fluid reservoir and having a connecting port to said displacement chamber;

c. a valve in said passage between said fluid chamber and said hydraulic fluid reservoir, having a valve surface exposed to said displacement chamber pressure to develop valve opening forcing thereon d. a passage between said fluid chamber and said output and a control diaphragm interposed across said passage in fluid sealing relationship;

e. a slidable plunger adjacent, but not connected to, said control diaphragm, and spring biasing means for urging said plunger toward said control diaphragm;

f. a rod connected between said plunger and said valve for translating control diaphragm deflection to valve opening and closing motion;

g. a valve passage between said displacement chamber and said reservoir, said valve passage having therein a check valve openable by an excess differential pressure in said reservoir relative to displacement chamber; and h. a slide valve connected to said pumping diaphragm and slidable over said valve passage to open said valve passage during a maximum deflection of said pumping diaphragm

2. The apparatus of claim 1, further comprising a mechanical stop in said displacement chamber, said mechanical stop being positioned so as to limit the deflection of said diaphragm while permitting the opening of said slide valve over said valve passage.

* * * * *